US005978974A

United States Patent [19]

Mullen

[11] Patent Number: 5,978,974

[45] Date of Patent: Nov. 9, 1999

[54] APPARATUS FOR RAISING AND AUTOMATICALLY LOWERING A TOILET SEAT

[76] Inventor: Michelle D. Mullen, 8224 Eucalyptus Dr., Bakersfield, Calif. 93306

[21] Appl. No.: 08/876,595

[22] Filed: Jun. 16, 1997

[51] Int. Cl.[6] ..... A47K 13/10

[52] U.S. Cl. ..... 4/246.5; 4/246.1; 4/246.3; 4/246.4

[58] Field of Search ..... 220/264; 4/246.5, 4/246.4, 248, 246.3, 246.1; 188/297, 283, 322.13

[56] References Cited

U.S. PATENT DOCUMENTS

| | | | |
|---|---|---|---|
| D. 273,128 | 3/1984 | Noddick | D23/71 |
| D. 309,091 | 7/1990 | Shepard | D8/305 |
| D. 356,022 | 3/1995 | Kostos et al. | D8/307 |
| 1,017,953 | 2/1912 | Buttman et al. | 188/322.13 |
| 1,590,298 | 6/1926 | Landis | 4/246.5 |
| 1,618,326 | 2/1927 | Cosentino | 188/283 |
| 3,528,075 | 9/1970 | Leon | 4/246.5 |
| 4,129,907 | 12/1978 | Vaughan et al. | 4/251 |
| 4,584,724 | 4/1986 | Wilson | 4/246.5 |
| 5,341,519 | 8/1994 | Cusenza | 4/246.1 |
| 5,375,267 | 12/1994 | Davis | 4/246.1 |
| 5,558,190 | 9/1996 | Chang | 188/322.13 |

*Primary Examiner*—David J. Walczak
*Assistant Examiner*—Tuan Nguyen

[57] ABSTRACT

A rod includes a plunger attached thereto between first and second ends of the rod. The plunger is disposed within a cylinder and the rod extends through opposing ends of the cylinder. The cylinder is adapted to be attached to a toilet beneath a toilet seat. The cylinder includes an adjustable air port at each of the opposing ends thereof. The rod is adapted to be oriented with the first end above the second end, and to have the first end pivotally attached to the toilet seat. A foot operated apparatus is adapted to be positioned below the toilet seat, and includes a foot pedal at one end and a connection device at an opposite end. The connection device is configured to be pivotally connected to the second end of the rod. A fulcrum is positioned on the foot operated apparatus between the foot pedal and the connection device. A user raises the toilet seat by pressing downward on the foot pedal so that the foot operated apparatus urges the rod axially upward in the direction of the toilet seat, thus lifting the toilet seat, then after using the toilet, the user releases the foot pedal, permitting the toilet seat to lower itself by gravity, the plunger urging against air in the cylinder beneath the plunger, the air leaking outward through the air port which is below the plunger, additional air entering the cylinder through the air port which is above the plunger.

4 Claims, 3 Drawing Sheets

APPARATUS FOR RAISING AND AUTOMATICALLY LOWERING A TOILET SEAT

BACKGROUND OF THE INVENTION

1. Field of the Invention

The present invention relates to toilet accessories, specifically apparatus for raising and lowering toilet seats.

2. Description of the Related Art

A common concern of women, who share toilet facilities with men, is that men tend to leave the toilet seat in a raised position. If a woman does not notice that the toilet seat is raised, she risks falling into the bowl and potentially becoming injured by attempting to sit on the toilet when the seat is raised.

A common problem faced by men when raising a toilet seat is that they must touch the actual seat, thus potentially receiving bacteria and other germs from the seat. In addition, people who have difficulty in bending over find it difficult to raise a toilet seat in the traditional way.

A single invention which is able to solve all of the above stated problems would be welcome by both men and women.

SUMMARY OF THE INVENTION

The apparatus of the present invention includes a rod having a plunger attached thereto between first and second ends of the rod. The plunger is disposed within a cylinder and the rod extends through opposing ends of the cylinder. The cylinder is adapted to be attached to a toilet beneath a toilet seat. The cylinder includes an adjustable air port at each of the opposing ends thereof The rod is adapted to be oriented with the first end above the second end, and to have the first end pivotally attached to the toilet seat. A foot operated apparatus is adapted to be positioned below the toilet seat, and includes a foot pedal at one end and a connection means at an opposite end. The connection means is configured to be pivotally connected to the second end of the rod. A fulcrum is positioned on the foot operated apparatus between the foot pedal and the connection means. A user raises the toilet seat by pressing downward on the foot pedal so that the foot operated apparatus urges the rod axially upward in the direction of the toilet seat, thus lifting the toilet seat. Then after using the toilet, the user releases the foot pedal, permitting the toilet seat to lower itself by gravity, the plunger urging against air in the cylinder beneath the plunger, the air leaking outward through the air port which is below the plunger, additional air entering the cylinder through the air port which is above the plunger.

In another embodiment, the foot operated apparatus is replaced by a hand operated apparatus having a handle positioned above the toilet seat.

Because the toilet seat is raised by a foot or hand operated apparatus having a handle above the toilet seat, a user does not have to bend over or touch the toilet seat in order to raise it, thus placing no stress on the user's back, and keeping the hands germ free.

Because the toilet seat is lowered by gravity when the foot or hand operated apparatus is released, a user does not have to remember to lower the seat after use, thus preventing accidents and frustration for a subsequent, female user of the toilet.

Because the plunger urges against air in the cylinder beneath the plunger when the toilet seat is lowered by gravity, the toilet seat is lowered slowly, preventing damage to the seat and loud noises from banging of the seat against the toilet.

Still further features and advantages will become apparent from the ensuing description and drawings.

DETAILED DESCRIPTION

Figure 1:
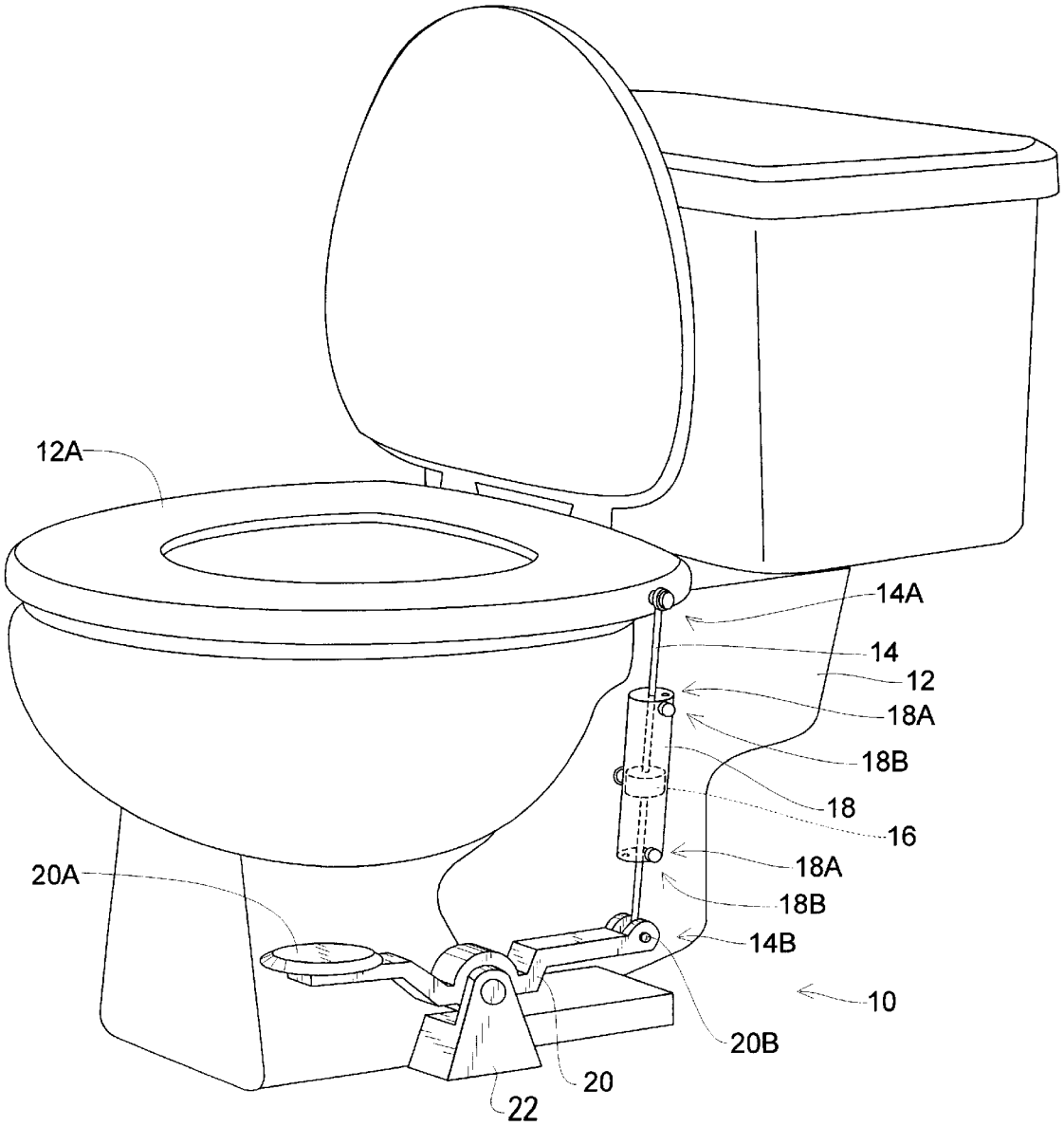
FIG. 1 is a perspective view of the apparatus of the present invention, connected to a toilet and ready for operation.

FIG. 1 is a perspective view of the apparatus 10 of the present invention, connected to a toilet 12 and ready for operation. The apparatus 10 includes a rod 14 having a plunger 16 attached thereto between first and second ends 14A, 14B of the rod 14. The plunger 16 is disposed within a cylinder 18 and the rod 14 extends through opposing ends 18A of the cylinder. The cylinder 18 is adapted to be pivotally attached to the toilet 12 beneath a toilet seat 12A. The cylinder 18 includes an adjustable air port 18B at each of the opposing ends 18A thereof. The details of the air ports 18B are well known in the art, and so are not disclosed herein.

The rod 14 is adapted to be oriented with the first end 14A above the second end 14B, and to have the first end 14A pivotally attached to the toilet seat 12A. A foot operated apparatus 20 is adapted to be positioned below the toilet seat 12A, and includes a foot pedal 20A at one end and a connection means 20B at an opposite end. The connection means 20B is configured to be pivotally connected to the second end 14B of the rod 14. A fulcrum 22 is positioned on the foot operated apparatus 20 between the foot pedal 20A and the connection means 20B.

Figure 2:
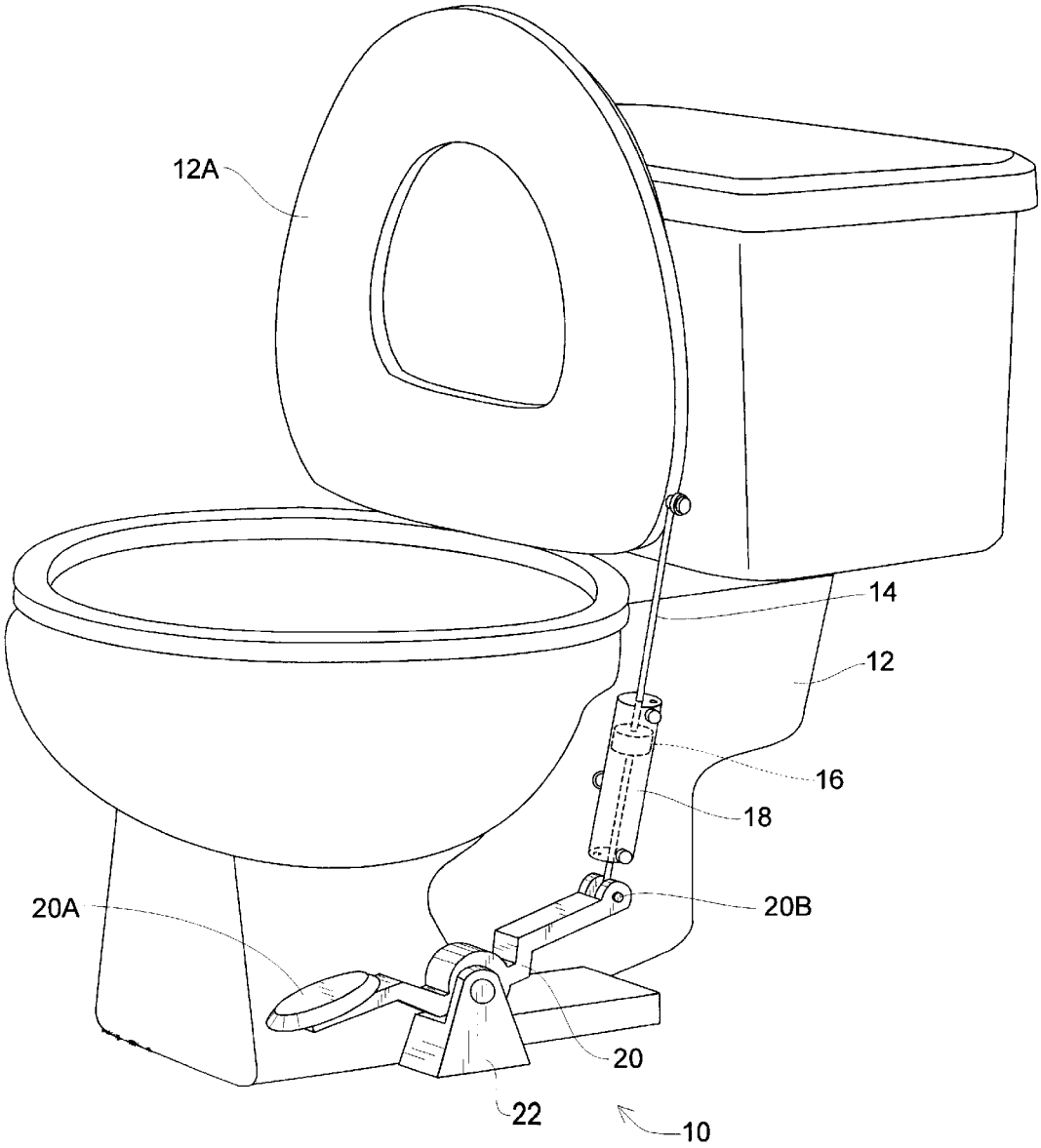
FIG. 2 is a perspective view of the apparatus and the toilet, with the toilet seat in a raised position.

FIG. 2 is a perspective view of the apparatus 10 and the toilet 12, with the toilet seat 12A in a raised position. Referring to FIGS. 1 and 2, a user (not shown) raises the toilet seat 12A by pressing downward on the foot pedal 20A so that the foot operated apparatus 20 urges the rod 14 axially upward in the direction of the toilet seat 12A, thus lifting the toilet seat 12A. Then after using the toilet 12, the user releases the foot pedal 20A, permitting the toilet seat 12A to lower itself by gravity. The plunger 16 urges against air in the cylinder 18 beneath the plunger 16, the air leaking outward through the air port 18B which is below the plunger 16, additional air entering the cylinder 18 through the air port 18B which is above the plunger 16.

It is immediately understandable to one skilled in the art, without further explanation, that the connection between the cylinder 18 and the toilet 12, or the connection between the first end 14A of the rod 14 and the toilet seat 12A, or the connection between the connection means 20B and the second end 14B of the rod, should be a lost motion type connection, to prevent the rod 14 from binding when the toilet seat 12A is raised.

Figure 3:
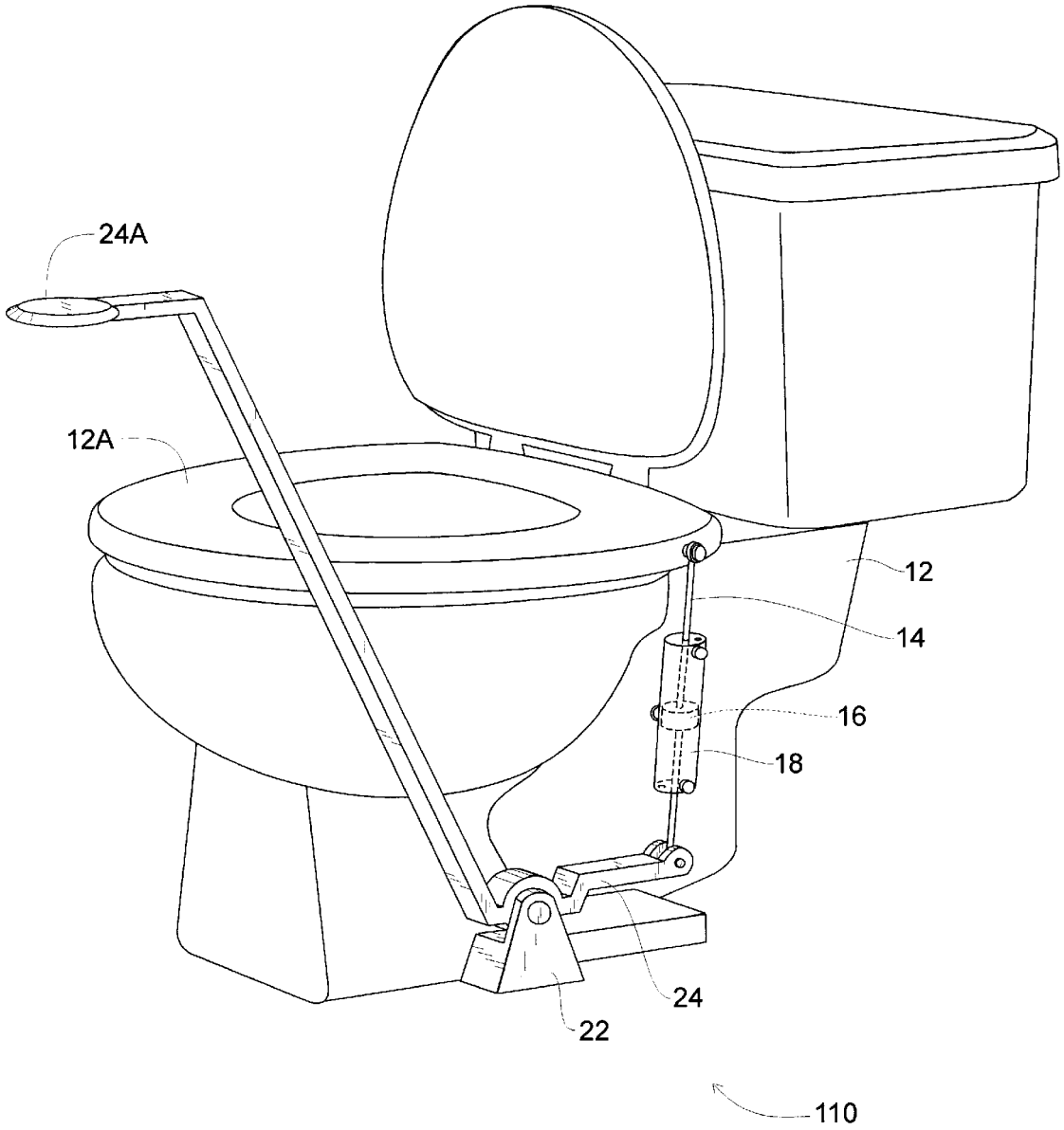
FIG. 3 is a perspective view of another embodiment of the present invention.

FIG. 3 is a perspective view of another embodiment 110 of the present invention, in which the foot operated apparatus 20 is replaced by a hand operated apparatus 24 having a handle 24A positioned above the toilet seat 12A, where it would be easily accessible by a user (not shown), without requiring the user to bend over.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. For example, the foot or hand operated apparatus 20, 24 may be replaced with a switch actuated motor configured to drive the rod 14, thus permitting a smaller overall device. The switch could be manually operated by foot or hand. Accordingly, the scope of the invention is to be limited only by the following claims and their legal equivalents.

The invention claimed is:

1. An apparatus for raising and automatically lowering a toilet seat comprising:

a. a rod having a plunger attached thereto between first and second ends of the rod;

b. the plunger disposed within a cylinder and the rod extending through opposing ends of the cylinder;

c. the cylinder adapted to be attached to a toilet beneath the toilet seat;

d. the cylinder having an air port at each of the opposing ends thereof, the air ports each being individually adjustable independently of each other to vary the rate of flow of air through the air port at a given pressure, the apparatus being devoid of any further air ports;

e. the rod adapted to be pivotally attached to the toilet seat at the first end thereof;

f. a rod moving means configured to be manually actuated and manually released;

g. the rod moving means adapted to urge the rod axially upward in a direction of the toilet seat when the moving means is actuated, thereby raising the toilet seat;

h. the rod moving means configured to permit the toilet seat to lower itself by gravity when the rod moving means is released;

i. wherein a user raises the toilet seat by manually actuating the rod moving means to urge the rod upward in the direction of the toilet seat, thus lifting the toilet seat, then after using the toilet releases the rod moving means, permitting the toilet seat to lower itself by gravity, the plunger urging against air in the cylinder beneath the plunger, the air leaking outward through the air port which is below the plunger, additional air entering the cylinder through the air port which is above the plunger.

2. The apparatus of claim 1, wherein the rod moving means is a foot operated device configured to be pivotally attached to the second end of the rod.

3. The apparatus of claim 1, wherein the rod moving means is a hand operated device configured to be pivotally attached to the second end of the rod.

4. An apparatus for raising and automatically lowering a toilet seat comprising:

a. a rod having a plunger attached thereto between first and second ends of the rod;

b. the plunger disposed within a cylinder and the rod extending through opposing ends of the cylinder;

c. the cylinder adapted to be attached to a toilet beneath the toilet seat;

d. the cylinder having an adjustable air port at each of the opposing ends thereof;

e. the rod adapted to be oriented with the first end above the second end, and to have the first end pivotally attached to the toilet seat;

f. a foot operated device adapted to be positioned below the toilet seat, and having a foot pedal at one end and a connection means at an opposite end, the connection means configured to be pivotally connected to the second end of the rod;

g. a fulcrum positioned on the foot operated device between the foot pedal and the connection means;

h. wherein a user can raise the toilet seat by pressing downward on the foot pedal so that the foot operated device urges the rod axially upward in the direction of the toilet seat, thus lifting the toilet seat, then after using the toilet the user can release the foot pedal, permitting the toilet seat to lower itself by gravity, the plunger urging against air in the cylinder beneath the plunger, the air leaking outward through the air port which is below the plunger, additional air entering the cylinder through the air port which is above the plunger.

* * * * *